US009393179B2

(12) United States Patent
Kawata

(10) Patent No.: US 9,393,179 B2
(45) Date of Patent: Jul. 19, 2016

(54) MEDICINE SUPPLY APPARATUS

(71) Applicant: Takazono Technology Incorporated, Hirakata-shi (JP)

(72) Inventor: Kenji Kawata, Hirakata (JP)

(73) Assignee: Takazono Technology Incorporated, Hirakata-shi (JP)

( * ) Notice: Subject to any disclaimer, the term of this patent is extended or adjusted under 35 U.S.C. 154(b) by 10 days.

(21) Appl. No.: 14/352,425

(22) PCT Filed: Oct. 16, 2012

(86) PCT No.: PCT/JP2012/076692

§ 371 (c)(1),
(2) Date: Apr. 17, 2014

(87) PCT Pub. No.: WO2013/058236

PCT Pub. Date: Apr. 25, 2013

(65) Prior Publication Data

US 2014/0239016 A1 Aug. 28, 2014

(30) Foreign Application Priority Data

Oct. 21, 2011 (JP) ..... 2011-232011

(51) Int. Cl.
*B67D 7/06* (2010.01)
*A61J 7/00* (2006.01)
(Continued)

(52) U.S. Cl.
CPC ..... *A61J 7/0076* (2013.01); *B65B 9/073* (2013.01); *B65B 37/04* (2013.01); *B65B 39/001* (2013.01); *B65B 39/02* (2013.01); *B65D 83/06* (2013.01); *B65B 39/08* (2013.01); *B65B 39/12* (2013.01)

(58) Field of Classification Search
CPC ..... A47F 1/02; A47F 1/08; B65D 83/06; B65D 39/001; B65D 39/02; B65D 39/08; B65D 39/12; B65D 37/04
USPC ..... 222/196, 200, 202–203, 460–462, 232, 222/181.1, 526–537, 408.5; 417/480; 141/331, 337, 344–345; 53/568–569
See application file for complete search history.

(56) References Cited

U.S. PATENT DOCUMENTS 2,936,994 A 5/1960 Lau
3,278,153 A 10/1966 Dallas
(Continued)

FOREIGN PATENT DOCUMENTS

CN 103124677 A 5/2013
DE 202005011346 U1 9/2005
(Continued)

OTHER PUBLICATIONS

Office Action dated Dec. 7, 2015 re corresponding Chinese Patent Application No. 2012800441357.
(Continued)

*Primary Examiner* — Paul R Durand
*Assistant Examiner* — Andrew P Bainbridge
(74) *Attorney, Agent, or Firm* — The Webb Law Firm

(57) ABSTRACT

An object of the present invention is to provide a medicine supply apparatus including a hopper in which medicine is not likely to remain. The medicine supply apparatus of the present invention includes a hopper and a deforming operation portion. A part of a lower portion of the hopper is configured as a deformable portion having flexibility. The deformable portion is deformable so as to open and close a passage. The deforming operation portion deforms the deformable portion to thereby open and close the passage, and applies vibrations to the deformable portion. The medicine adhering to an inner surface of the deformable portion is processed by the vibrations.

5 Claims, 6 Drawing Sheets

(51) Int. Cl.

| | |
|---|---|
| ***B65D 83/06*** | (2006.01) |
| ***B65B 37/04*** | (2006.01) |
| ***B65B 39/00*** | (2006.01) |
| ***B65B 39/02*** | (2006.01) |
| ***B65B 9/073*** | (2012.01) |
| *B65B 39/08* | (2006.01) |
| *B65B 39/12* | (2006.01) |

(56) References Cited

U.S. PATENT DOCUMENTS

| | | | | |
|---|---|---|---|---|
| 3,308,898 | A | 3/1967 | Allen et al. | |
| 5,127,483 | A | 7/1992 | Hough | |
| 6,253,968 | B1 * | 7/2001 | Van Dijk | G01F 11/088 222/181.2 |
| 6,647,702 | B1 * | 11/2003 | Kim | B65B 9/087 53/374.4 |
| 7,118,010 | B2 * | 10/2006 | Crowder | A61M 15/0045 222/1 |
| 2013/0161355 | A1 | 6/2013 | Kawata | |

FOREIGN PATENT DOCUMENTS

| | | | |
|---|---|---|---|
| JP | 5412369 | Y2 | 5/1979 |
| JP | 1072094 | A | 3/1998 |
| JP | 2004196403 | A | 7/2004 |
| JP | 200529294 | A | 2/2005 |
| JP | 2005110786 | A | 4/2005 |
| JP | 201251629 | A | 3/2012 |

OTHER PUBLICATIONS

Office Action dated Jan. 22, 2016 re corresponding Japanese Patent Application No. 2011-232011.

* cited by examiner

MEDICINE SUPPLY APPARATUS

CROSS-REFERENCE TO RELATED APPLICATIONS

This application is the United States national phase of International Application No. PCT/JP2012/076692 filed Oct. 16, 2012, and claims priority to Japanese Patent Application No. 2011-232011, the disclosures of which are hereby incorporated in their entirety by reference.

The present application claims priority to Japanese Patent Application No. 2011-232011, the contents of which are incorporated by reference herein.

FIELD

The present invention relates to a medicine supply apparatus including a hopper including a passage that allows medicine to pass downward therethrough.

BACKGROUND

A medicine dispensing and packing apparatus or the like includes a built-in medicine supply apparatus. The medicine supply apparatus includes a hopper. The hopper includes a passage that allows fluid medicine such as powders and tablets to pass downward therethrough (for example, Patent Literature 1).

A hopper described in Patent Literature 1 includes a supply container that can temporarily store medicine such as powders supplied thereto. The lower end of the supply container is opened. The supply container includes an opening and closing plate that can open and close the opened portion and is supported by a hinge. When the opening and closing plate is moved, the medicine can be taken out of the supply container.

Meanwhile, in the hopper including the opening and closing plate, the opening and closing plate is located in contact with the medicine. Hence, the medicine is likely to remain on the surface of the opening and closing plate and in gaps and irregularities existing in the hinge portion of the opening and closing plate and the like. In the case where the type of medicine supplied to the hopper is changed, the remaining medicine needs to be removed from the hopper in order to avoid contamination. In this case, there occurs a problem that the cleaning work of the hopper including the opening and closing plate, in which such gaps and irregularities exist, is troublesome.

CITATION LIST

Patent Literature

Patent Literature 1: Japanese Patent Laid-Open No. 2005-110786

SUMMARY

Technical Problem

In view of the above, the present invention has an object to provide a medicine supply apparatus including a hopper in which medicine is not likely to remain.

Solution to Problem

The present invention provides a medicine supply apparatus including: a hopper including a passage that allows medicine to pass downward therethrough; and a deforming operation portion. A part of a lower portion of the hopper is configured as a deformable portion having flexibility. The deformable portion is deformable so as to open and close the passage. The deforming operation portion deforms the deformable portion to thereby open and close the passage, and applies vibrations to the deformable portion. The medicine adhering to an inner surface of the deformable portion is processed by the applied vibrations.

Then, in the present invention, the deformable portion may include hopper's lock portions located on one side and another side with the passage therebetween to be engaged with the deforming operation portion, the deforming operation portion may include a pair of operation pieces that are located so as to sandwich the deformable portion from the one side and the other side, and each of the operation pieces may include a deforming operation portion's lock portion to be engaged with the hopper's lock portion.

Moreover, the deforming operation portion may include the pair of operation pieces that are located so as to sandwich the deformable portion from the one side and the other side with the passage therebetween, and each of the operation pieces may generate the vibrations by repeating: a movement in a direction in which the passage in the deformable portion is widened; and a movement in a direction in which the passage in the deformable portion is narrowed.

The present invention further provides a medicine supply apparatus including: a hopper including a passage that allows medicine to pass downward therethrough; an opening and closing portion; and a deformable portion vibrator. A part of a lower portion of the hopper is configured as a deformable portion having flexibility. The deformable portion is deformable so as to open and close the passage. The opening and closing portion deforms the deformable portion to thereby open and close the passage. The deformable portion vibrator applies vibrations to the deformable portion. The medicine adhering to an inner surface of the deformable portion is processed by the applied vibrations.

Moreover, the process for the medicine may include vibrating the deformable portion to thereby separate the medicine adhering to the inner surface of the deformable portion from the inner surface.

DESCRIPTION OF EMBODIMENTS

Figure 2:
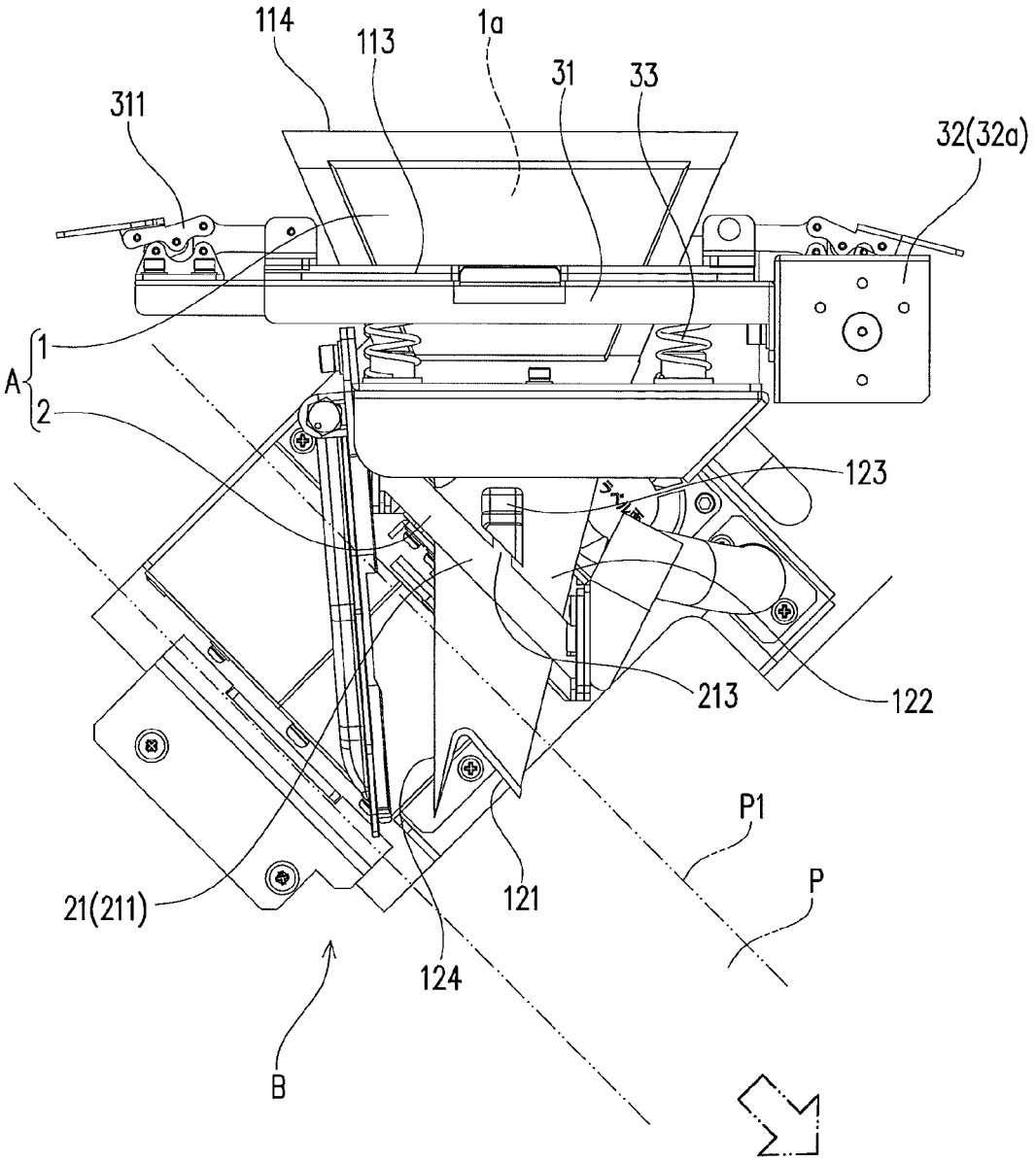
FIG. 2 is a front view illustrating a main portion of a medicine dispensing and packing apparatus to which the hopper according to the embodiment of the present invention is attached.

Now, the present invention is described by way of embodiments. A hopper 1 is first described. The hopper 1 constitutes a part of a medicine supply apparatus A together with a deforming operation portion 2 to be described later. As illustrated in FIG. 2, the medicine supply apparatus A is combined with a dispensing and packing apparatus B to thereby constitute a medicine dispensing and packing apparatus. Medicine M that is caused to pass through the hopper 1 may be any of powders and tablets. Moreover, powders and tablets may be caused to pass together through the hopper 1.

—Configuration of Hopper—

Figure 1:
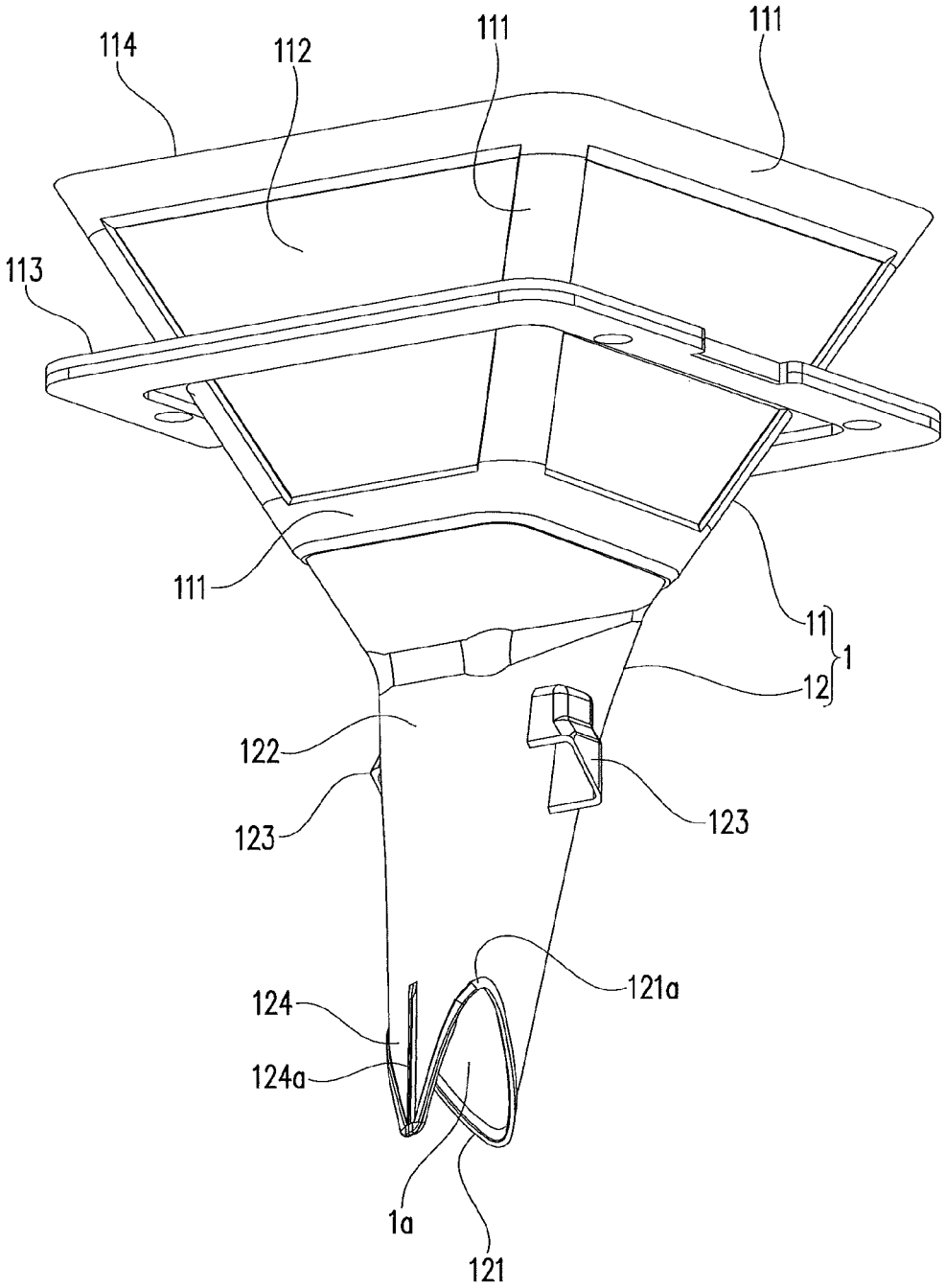
FIG. 1 is a perspective view illustrating a hopper according to an embodiment of the present invention, which is observed from the bottom side.

The hopper 1 of the present embodiment has a shape illustrated in FIG. 1, and includes a passage 1*a* (see FIG. 6) that allows the medicine M to pass downward therethrough. Then, in the medicine dispensing and packing apparatus, the hopper 1 is attached such that the passage 1*a* runs in the top-bottom direction. The hopper 1 includes a hopper body 11 and a nozzle 12. The hopper body 11 corresponds to an upper portion of the hopper 1. The medicine M can be stored in the hopper body 11. The nozzle 12 is located below the hopper body 11. The lower end of the nozzle 12 is a medicine output port 121. The medicine M stored in the hopper body 11 can be taken out from the medicine output port 121. To take out the medicine M, the cross sectional area of the passage 1*a* is smaller in the nozzle 12 than in the hopper body 11. Note that members (for example, an opening and closing plate and a hinge) constituting an opening and closing mechanism for opening and closing the passage 1*a* do not exist in a space of the passage 1*a* through which the medicine M passes.

In the present embodiment, the material of the hopper 1 is rubber (more specifically, silicon rubber), and the entire hopper 1 is integrally molded. Because the hopper 1 is integrally molded in this manner, the inner surface of the hopper 1 can be formed without any joint and step, and the medicine M can be made less likely to remain on the inner surface. In addition to this, as described above, members constituting the opening and closing mechanism do not exist in the space of the passage 1*a* through which the medicine M passes. Hence, in the hopper 1 of the present embodiment, a portion in which the medicine M can remain is eliminated from a route through which the medicine M passes. Accordingly, the medicine M is less likely to remain in the entire hopper 1. Note that the present invention is not limited to an embodiment using the integral molding, and the hopper 1 may be formed by combining separate members. In the case where the hopper 1 is formed by combining separate members, a deformable portion 122 needs to be formed using a deformable material as described later, but the other portions can be formed using various materials. Examples of the materials include metal, hard resin, and paper. Moreover, even the deformable portion 122 can be formed using not only rubber but also paper or a resin sheet as long as the used material is deformable.

Moreover, the hopper 1 of the present embodiment does not include a mechanism (such as the opening and closing plate of the hopper described in Patent Literature 1) that is constituted by a member separate from the hopper 1 and can open and close the passage 1*a* for the purpose of allowing the medicine M to pass downward therethrough and keeping the medicine M in the hopper 1, or other purposes. The hopper 1 of the present embodiment includes the deformable portion 122 for opening and closing the passage 1*a*. Then, the medicine supply apparatus A includes the deforming operation portion 2 as an opening and closing portion for deforming the deformable portion 122. The deformable portion 122 and the deforming operation portion 2 are described later.

Then, the inner surface of the hopper 1 of the present embodiment is subjected to surface treatment for reducing friction against the medicine M passing through the passage 1*a*. This makes the medicine M less likely to remain on the inner surface of the hopper 1. In the present embodiment, the surface treatment is coating (for example, resin coating) using a material different from that of the hopper 1. Alternatively, chemical treatment in which, for example, the inner surface is melted using a chemical substance, or physical treatment in which, for example, the inner surface is sandblasted may be adopted provided that the friction against the medicine M can be reduced.

—Hopper Body—

The hopper body 11 is a trumpet-shaped portion that becomes larger upward, and the laterally cross sectional shape thereof in the present embodiment is substantially square. The hopper body 11 includes: a frame body 111 that is formed in the outer edge and four corners thereof and has a relatively large plate thickness and a high stiffness; and a flat plate portion 112 that is surrounded by the frame body 111 and has a relatively small plate thickness and a low stiffness. The frame body 111 is provided to impart shape retainability. More specifically, the frame body 111 is provided to prevent the hopper 1 from deforming due to its own weight of the hopper 1 and the weight and dropping pressure of the medicine M passing through the passage 1*a*. One of the reasons why the flat plate portion 112 has a relatively low stiffness is to save the material, and another thereof is to force the remaining medicine M to drop when the inner surface of the flat plate portion 112 is undulated by vibrating the hopper 1 by means of a vibrator 32 to be described later.

Figure 6:
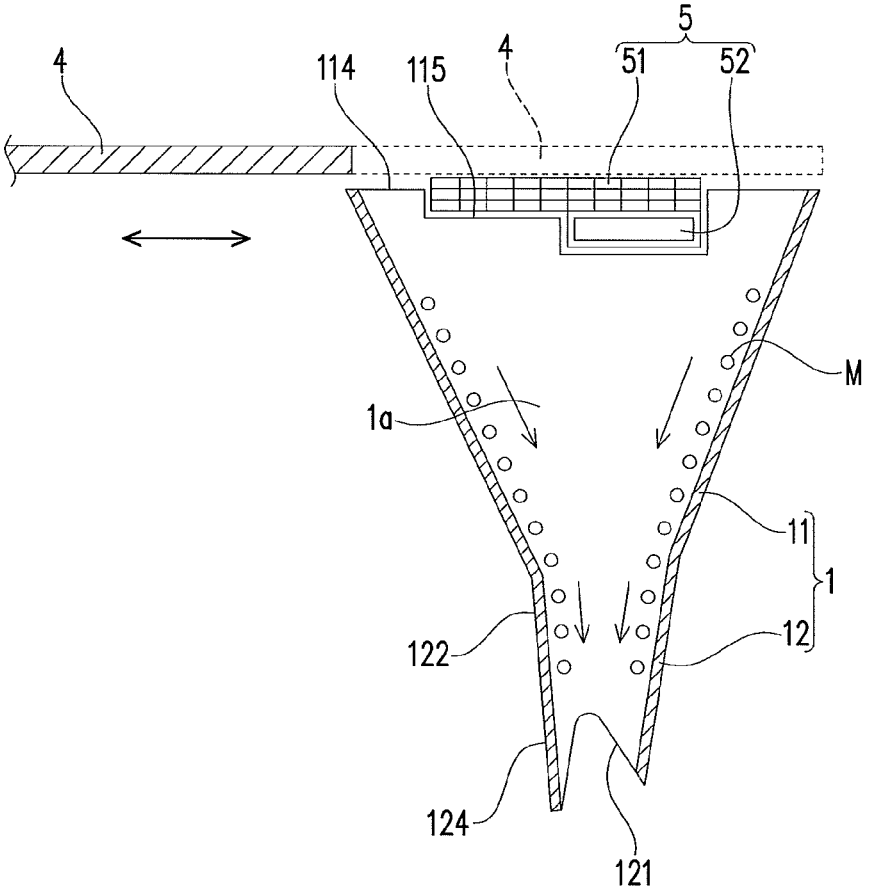
FIG. 6 is a schematic longitudinal sectional view illustrating the hopper and an opening and closing shutter according to the embodiment of the present invention.

As illustrated in FIG. 2, an upper end edge 114 of the hopper body 11 is horizontally arranged. Moreover, as illustrated in FIG. 6, a cut-out portion 115 cut out downward is formed in one of four sides of the upper end edge 114. As described later, a suction portion 5 that suctions remaining medicine is located in the cut-out portion 115.

A plate-shaped holder mounting portion 113 protrudes from the outer side surface of the hopper body 11. The hopper 1 is fixed to the medicine supply apparatus A using the holder mounting portion 113. In the present embodiment, the holder mounting portion 113 is provided so as to protrude in the horizontal direction in the entire periphery of the hopper body 11, but various shapes may be adopted for the holder mounting portion 113 as long as the hopper 1 can be fixed.

—Nozzle—

The nozzle 12 is provided so as to be continuous with the lower end of the hopper body 11, and has a shape in which the laterally cross sectional area of the passage 1*a* becomes smaller downward. Then, the lower end of the nozzle 12 is opened and is configured as the medicine output port 121. The lower end thereof is obliquely cut for the following reason.

That is, as illustrated in FIG. 2, the medicine output port 121 in the medicine dispensing and packing apparatus is made substantially parallel to a side end P1 of a packing paper P half-folded in the width direction, whereby the conveyance of the packing paper P is not prevented. Moreover, the plate thickness of a lower end edge 121*a* corresponding to the periphery of the medicine output port 121 is larger than those of the other portions of the nozzle 12. Hence, the lower end edge 121*a* secures the shape retainability of the lower end of the nozzle 12.

—Deformable Portion—

In the present embodiment, because the hopper 1 is integrally molded using silicon rubber, it is a matter of course that the material of the nozzle 12 is silicon rubber. Hence, the entire nozzle 12 corresponds to the deformable portion 122 having flexibility, and the deformable portion 122 is deformable so as to open and close the passage 1*a*. The opening and closing is performed by the deforming operation portion 2 to be described later. Note that, in terms of economic efficiency, it is desirable to form the deformable portion 122 using a material that can maintain not only flexibility but also shape restorability over a long period. The deformable portion 122 enables the medicine M to be temporarily stored in the hopper 1. Note that, in the case where the hopper 1 is formed by combining separate members, not the entirety but only a part of the nozzle 12 may be configured as the deformable portion 122.

Here, the following three examples can be conceived as the implications of the "opening and closing". (1) The passage 1*a* is forcibly opened and closed. (2) The passage 1*a* is forcibly closed, and is naturally opened by the elastic force of the deformable portion 122 and the like. (3) The passage 1*a* is forcibly opened, and is naturally closed by the elastic force of the deformable portion 122 and the like. The implications of the "opening and closing" also include the case where the passage 1*a* stops in a half-opened state or a half-closed state. Namely, an aspect of closing the passage 1*a* is not limited to a completely-closed state, and also includes the state where the passage 1*a* is closed with an opening being left, the opening being small enough to block the medicine M from being taken out. Meanwhile, an aspect of opening the passage 1*a* also includes the state where the passage 1*a* is opened with a slight opening, as long as the opening is large enough to substantially allow the medicine M to pass therethrough. Note that, even in the case where the passage 1*a* is half-opened as described above, because the nozzle 12 has the shape in which the laterally cross sectional area of the passage 1*a* becomes smaller downward, the dropping medicine M hits against the inner surface of the nozzle 12, and the dropping speed of the medicine M thus decreases. As a result, the medicine M that has dropped on the packing paper P half-folded in the width direction can be prevented from jumping and flying upward (referred to as "upward scattering").

Moreover, in the present embodiment, the passage 1*a* in the deformable portion 122 is opened in the case where external force is not applied to the deformable portion 122, and the passage 1*a* therein is forcibly closed by the deforming operation portion 2 to be described later. Conversely, the deformable portion 122 may be formed such that the passage 1*a* is closed in the case where external force is not applied to the deformable portion 122 and that the passage 1*a* is opened by the deforming operation portion 2.

The laterally cross sectional shape of the deformable portion 122 has at least one short side and two long sides adjacent to the short side. In the present embodiment, the upper portion of the nozzle 12 has a square shape that has chamfered corners and is coincident with the shape of the hopper body 11, the middle portion thereof has a rectangular shape that has chamfered corners and has two short sides and two long sides, and the lower portion thereof has an isosceles triangular shape that has chamfered corners and has one short side and two long sides as illustrated in FIG. 1.

The deformable portion 122 is deformed by the deforming operation portion 2 to be described later such that the long sides approach or separate from each other. At this time, the short side(s) in the cross sectional shape bend(s). That is, if the inner surface of the deformable portion 122 is widened and narrowed, the medicine M can be allowed to pass downward therethrough, and the medicine M can be kept at a position above the deforming operation portion 2 (more specifically, pressing portions 211) of the hopper 1. In this way, the passage 1*a* can be opened and closed by only such deformation of the deformable portion 122, and hence a mechanism (such as the opening and closing plate described in Patent Literature 1) made of a member separate from the hopper 1 does not need to be provided at a position at which the medicine M passing through the passage 1*a* comes into contact. Accordingly, the medicine M is less likely to remain in the hopper 1, and the cleaning work is facilitated. Moreover, because the structure of the hopper 1 can be simplified, ultimately, the cleaning of the hopper 1 is not presupposed, and a disposable hopper 1 can be adopted.

—Hopper's Lock Portions—

The deformable portion 122 includes hopper's lock portions 123 on an outer surface thereof. The hopper's lock portions 123 serve to deform the deformable portion 122 in the direction in which the passage 1*a* is opened. As illustrated in FIG. 1, the deformable portions 122 of the present embodiment are respectively provided as pocket-shaped portions opened downward, on the outer surfaces of the long sides of the deformable portion 122. When the hopper 1 is attached to the medicine dispensing and packing apparatus, as illustrated in FIG. 2, hooking portions 213 (to be described later) of operation pieces 21 are respectively inserted into the pocket-shaped hopper's lock portions 123. Then, the passage 1*a* in the deformable portion 122 can be opened along with an operation of the operation pieces 21.

It is sufficient that the hopper's lock portions 123 allow the operation pieces 21 to respectively engage therewith such that the deformable portion 122 follows an operation of the operation pieces 21, and various manners of engagement, such as bonding, clasp fastening, and fitting can be adopted for the engagement. Note that, because the hopper's lock portions 123 are pocket-shaped in the present embodiment, at the time of detaching the hopper 1, the hooking portions 213 of the operation pieces 21 are respectively disengaged from the hopper's lock portions 123 by only moving the hopper 1 upward. Hence, the detachment work of the hopper 1 is facilitated, and this also facilitates the cleaning work of the hopper 1. Moreover, the hopper's lock portions 123 may be provided inside of the nozzle 12 in some cases.

—Upward Scattering Preventing Portion—

An upward scattering preventing portion 124 is formed on the upstream side in the moving direction (see FIG. 2) of the packing paper P, at the lower end of the nozzle 12 so as to protrude downward. Here, the medicine M that has dropped on the packing paper P half-folded in the width direction may bounce and fly upward (referred to as "upward scattering"). The upward scattering preventing portion 124 can prevent the medicine M from invading the upstream side of the half-folded packing paper P, and hence the "upward scattering" can be suppressed. Moreover, a reinforcement portion 124*a* having a plate thickness larger than those of the other portions of the nozzle 12 is provided in the top-bottom direction on the outer surface of the upward scattering preventing portion 124. Hence, the reinforcement portion 124*a* secures the shape retainability of the lower end of the nozzle 12, together with the lower end edge 121*a*. Note that, in the hopper 1 of the present invention, the formation of the upward scattering preventing portion 124 is not essential and may be omitted.

—Medicine Supply Apparatus/Medicine Dispensing and Packing Apparatus—

Next, the medicine supply apparatus A and the medicine dispensing and packing apparatus are described. The medicine supply apparatus A includes the hopper 1 and the deforming operation portion 2 as the opening and closing portion that opens and closes the passage 1*a*, for taking out a predetermined amount of the medicine M. Then, the medicine dispensing and packing apparatus includes: the medicine supply apparatus A; and the dispensing and packing apparatus B for packing the medicine M supplied by the medicine supply apparatus A with the packing paper P. The dispensing and packing apparatus B half-folds, in the width direction, the packing paper P continuously supplied in the length direction, packs a dose of the medicine M supplied from the medicine supplying container with the packing paper P, and then bonds the periphery of the packing paper P through heat-sealing and the like. A main portion of the medicine dispensing and packing apparatus is illustrated in FIG. 2. A portion indicated by a chain double-dashed line is the packing paper P half-folded in the width direction. The moving direction of the packing paper P is a direction indicated by an arrow in FIG. 2.

Note that the lower end of the nozzle 12 of the hopper 1 is located so as to be sandwiched by the half-folded packing paper P as illustrated in FIG. 2. Moreover, the end face shape of the medicine output port 121 has such an isosceles triangular shape as illustrated in FIG. 1 and FIG. 3, and the top of the shape faces the downstream side in the moving direction of the packing paper P.

—Operation Pieces—

Figure 3:
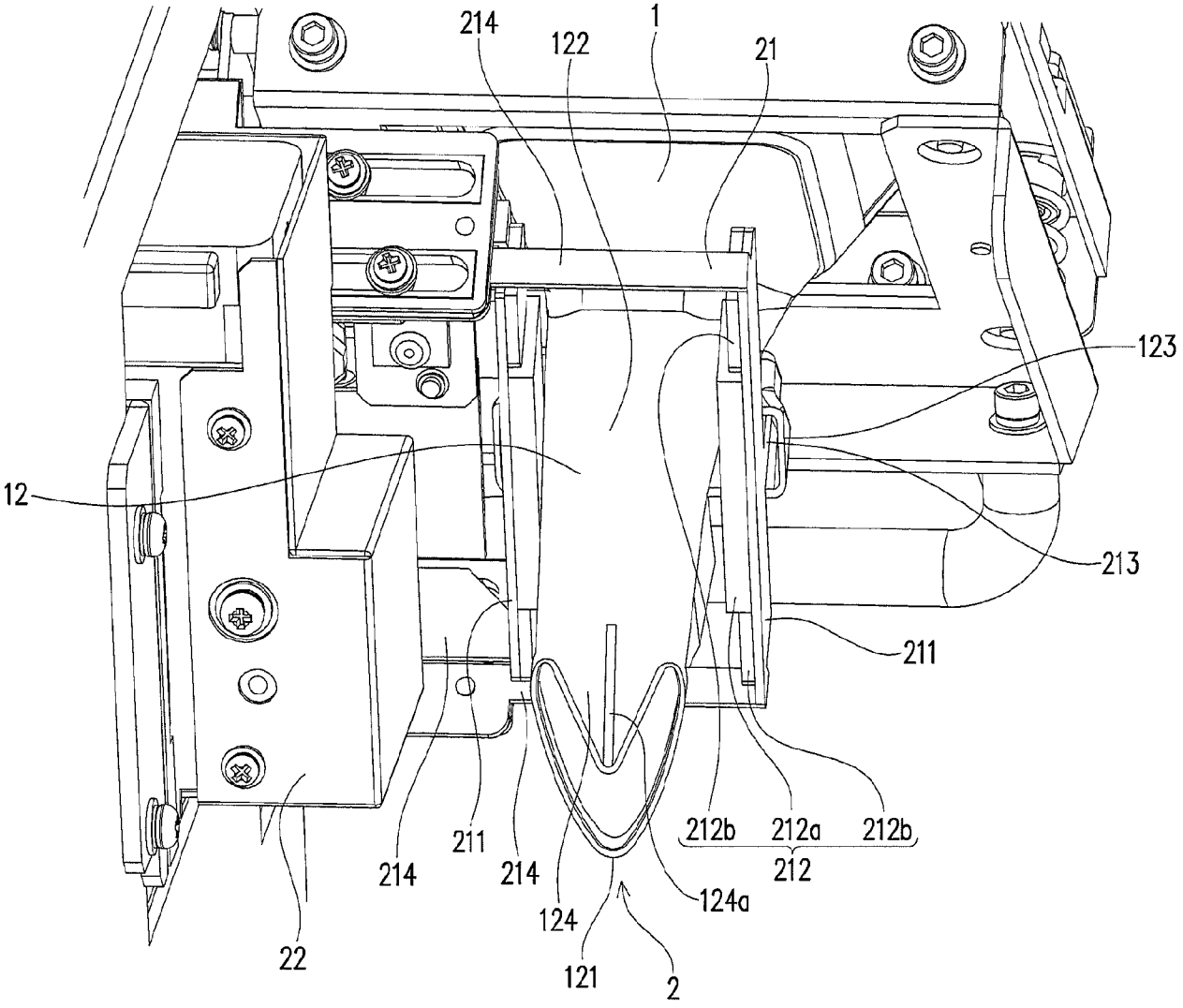
FIG. 3 is a side view of a main portion illustrating an area around an opening and closing portion in the medicine dispensing and packing apparatus to which the hopper according to the embodiment of the present invention is attached.

As illustrated in FIG. 3, the deforming operation portion 2 includes: a pair of operation pieces 21 that are provided at such positions as to sandwich the deformable portion 122 in the nozzle 12 of the hopper 1 from one side and another side; and a driving portion 22 for moving the operation pieces 21. Each operation piece 21 is made of metal, and has a shape rectangular in cross section whose one side is cut. The operation pieces 21 each include: an elongated plate-shaped pressing portions 211 that can come close to or approach the deformable portion 122 so as to press the deformable portion 122; and coupling portions 214 that extend from both ends of the pressing portions 211 to the driving portion 22. The pressing portions 211, 211 are provided so as to extend in an oblique direction (that is, so as to extend across the deformable portion 122 in lateral view, in a direction that intersects with the top-bottom direction). Moreover, the pressing portions 211, 211 are parallel to each other with the deformable portion 122 being sandwiched therebetween. As illustrated in FIG. 2, the pressing portions 211, 211 are provided outside of the packing paper P moving in the medicine dispensing and packing apparatus so as to be parallel to the side edges of the packing paper P.

The pressing portions 211, 211 are provided outside of the packing paper P for the following reasons. That is, if the pressing portions 211, 211 are provided inside of the lines on which the packing paper P is located (the range indicated by the chain double-dashed line in FIG. 2), a timing at which a paper holder (not shown) for nipping the packing paper P on the downstream side of the nozzle 12 nips the packing paper P coincides with a timing at which the deforming operation portion 2 opens the deformable portion 12 (that is, the two portions apply contradictory forces to the packing paper P), and this can be a cause of tearing the packing paper P. Further, if the pressing portions 211, 211 are provided inside of the lines on which the packing paper P is located, the medicine M may adhere to the pressing portions 211, 211 themselves.

Figure 4A:
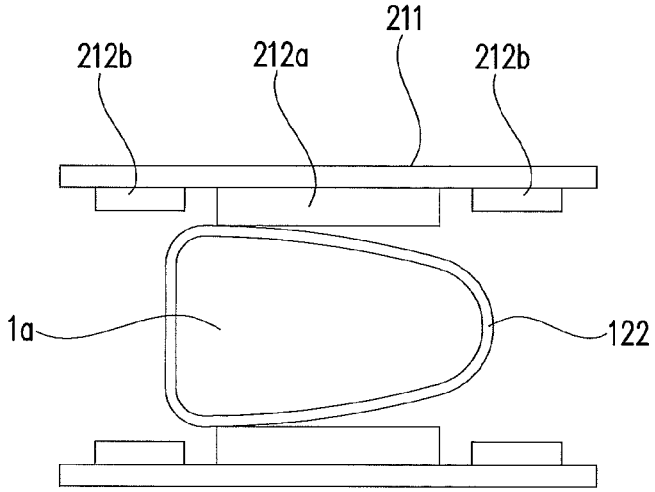
FIG. 4A is a schematic cross sectional view taken along pressing portions, the view illustrating an opened state of an opened/closed state of a deformable portion by means of the opening and closing portion according to the embodiment of the present invention.

Moreover, the operation pieces 21 are provided at positions higher than the lower end of the hopper 1. As a result, the positional relationship between the operation pieces 21 and the passage 1*a* is as illustrated in FIG. 4A. Hence, the operation pieces 21 are separated by the hopper 1 from the medicine M passing through the passage 1*a*, and the medicine M does not remain around the operation pieces 21. Note that, if the operation pieces 21 are provided as closer to the lower end of the hopper 1 as possible, the dropping distance of the medicine M is made shorter, and the "upward scattering" of the medicine M can be made less likely to occur.

In the present embodiment, as illustrated in FIG. 3, the driving portion 22 is provided lateral to the nozzle 12. The operation piece 21 in the right of FIG. 3 moves leftward when closing the passage 1*a* of the hopper 1, and the operation piece 21 in the left of FIG. 3 moves rightward when closing the passage 1*a* of the hopper 1. The driving portion 22 is driven by a motor, and the coupling portions 214 are moved leftward and rightward in FIG. 3 by gear engagement (not shown). During such movement, the pressing portions 211, 211 are kept parallel to each other.

The shape and operation of the pressing portions 211 are not limited to those in the present embodiment, and can be variously changed. Examples thereof include: using a cantilever; cylinder driving; electromagnetic driving; and turning a pressing portion in a fan-like fashion with a hinge being provided at one end thereof. In short, the shape and operation of the pressing portions 211 can be changed to any configuration as long as the pressing portions 211 can move with respect to the deformable portion 122 and can deform the deformable portion 122 such that the passage 1*a* is opened and closed. Moreover, a configuration can also be adopted in which: only the operation in the pressing direction (the approaching direction toward the deformable portion 122) is made by the driving portion 22; and the operation in the opposite direction is made by repulsive force of a spring or the like (not by the driving portion 22).

Moreover, in the case where the deformable portion 122 of the hopper 1 is molded such that the passage 1*a* is closed when external force is not applied thereto and that the passage 1*a* is opened by the deforming operation portion 2, a configuration may be adopted in which the operation pieces 21 are not provided with the pressing portions 211 and are provided with, for example, only the hooking portions 213 to be described later in order to open the passage 1*a*.

—Cushioning Portions—

The pressing portions 211, 211 of the present embodiment each include cushioning portions 212 having elasticity on an inner surface (that is, a portion facing the deformable portion 122 of the hopper 1) thereof. The cushioning portions 212 can absorb unevenness of the thickness of the deformable portion 122 that is caused by a molding error of the hopper 1. That is, in the case where the thickness of the deformable portion 122 is not even in the entire periphery thereof, if the pressing portions 211, 211 that are made of metal and do not have elasticity as in the present embodiment directly press the deformable portion 122, it is difficult to bring the deformable portion 122 into close contact with and completely close the passage 1*a*. In view of this, the cushioning portions 212 serve to press a portion of the deformable portion 122 having a smaller thickness, with a relatively large force. Then, the cushioning portions 212 serve to press a portion of the deformable portion 122 having a larger thickness, with a relatively small force. Hence, the passage 1*a* can be completely closed. Note that only any one of the pressing portions 211, 211 may include the cushioning portions 212 on the inner surface thereof in some cases.

Figure 4B:
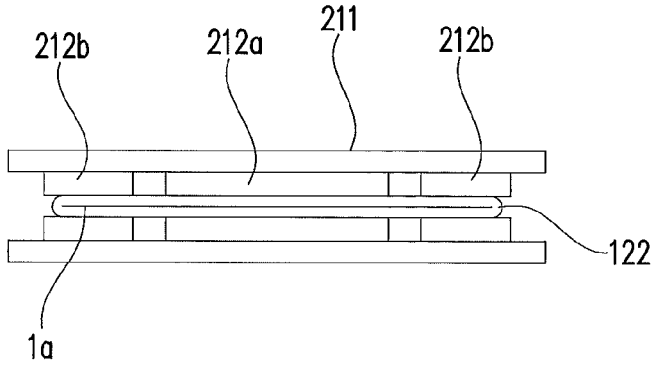
FIG. 4B is a schematic cross sectional view taken along the pressing portions, the view illustrating a closed state of the opened/closed state of the deformable portion by means of the opening and closing portion according to the embodiment of the present invention.

Here, in order to bring the deformable portion 122 into close contact with and close the passage 1*a*, as illustrated in FIG. 4B, it is necessary to deform the deformable portion 122 such that ends of the passage 1*a* are folded. Hence, unless a larger pressing force is applied to the ends of the passage 1*a* than to the central portion of the passage 1*a*, the passage 1*a* cannot be completely closed. Accordingly, in the present embodiment, a center-side cushioning portion 212*a* in the extension direction of each of the pressing portions 211, 211 has a larger elasticity than that of end-side cushioning portions 212*b* thereof. In other words, the center-side cushioning portion 212*a* is softer than the end-side cushioning portions 212*b*. In the present embodiment, the center-side cushioning portion 212*a* is made of sponge, and the end-side cushioning portions 212*b* are made of rubber. As a result, a larger pressing force can be applied to the ends of the passage 1*a* in such a state as illustrated in FIG. 4B, and hence the passage 1*a* can be reliably closed. Note that, in the present embodiment, the center-side cushioning portion 212*a* is thicker than the end-side cushioning portions 212*b* in order to take a balance in pressing force. As a result, the center-side cushioning portion 212*a* first presses the central side of the deformable portion 122, and the end-side cushioning portions 212*b* press the central side of the deformable portion 122 a little later. Accordingly, the passage 1*a* can be reliably closed without an occurrence of contact unevenness.

The pressing portions 211 of the operation pieces 21, 21 of the present embodiment each integrally include the hooking portion 213 that protrudes upward. As illustrated in FIG. 2 and FIG. 3, the hooking portions 213 are respectively inserted into the pocket-shaped hopper's lock portions 123 provided to the nozzle 12. When the pressing portions 211 move in the separating direction from the deformable portion 122, the hooking portions 213 move the deformable portion 122 in the direction in which the passage 1*a* is opened. As a result, the passage 1*a* can be reliably opened. Note that, instead of using the hooking portions 213, the passage 1*a* may be naturally opened by the elasticity of the deformable portion 122 itself.

—Remaining Medicine Process by Operation Pieces—

The deforming operation portion 2 of the present embodiment is used as the opening and closing portion for opening and closing the passage 1*a* in the deformable portion 122. Then, the deforming operation portion 2 is also used (doubles) as a deformable portion vibrator for a remaining medicine process of the hopper 1 (particularly, the deformable portion 122). Specifically, the deforming operation portion 2 is used to perform a process of removing remaining medicine that is the medicine M adhering to the inner surface of the hopper 1.

Here, in the case where the deforming operation portion 2 is used as only the opening and closing portion, the deformable portion 122 is sandwiched by the deforming operation portion 2. As a result, the inner surfaces of the deformable portion 122 are brought into close contact with each other. Then, in the hopper 1, the medicine M is stored above the portion in which the inner surfaces are brought into close contact with each other. Hence, the medicine M is in contact with the close-contact portion and the vicinity of this portion for a long time. Moreover, when the deforming operation portion 2 sandwiches the deformable portion 122, the medicine M is pushed against the inner surfaces of the deformable portion 122 by the pressing force of the deforming operation portion 2. As a result, the medicine M may firmly adhere to the inner surfaces of the deformable portion 122. Accordingly, in a lower portion of the hopper 1, the medicine M is likely to remain in the close-contact portion and the vicinity of this portion. In view of this, if the deforming operation portion 2 is used (doubles) as the deformable portion vibrator for vibrating the deformable portion, the remaining medicine process is performed on these portions.

Description is given below for an operation of the operation pieces 21 in the case where the deforming operation portion 2 is used for the remaining medicine process of the hopper 1. In this case, the operation pieces 21 reciprocate so as to repeat a movement in a further separating direction (see FIG. 5A) and an opposite movement in an approaching direction of the passage 1*a* of the hopper 1 (see FIG. 5B), from the state where the passage 1*a* of the hopper 1 is opened (see FIG. 4A). That is, assuming that the state illustrated in FIG. 4A is a neutral state where the passage 1*a* is not opened and not closed, the state illustrated in FIG. 5A is a state where the passage 1*a* is further opened from the neutral state, and the state illustrated in FIG. 5B is a state where the passage 1*a* is slightly closed from the neutral state.

Figure 5A:
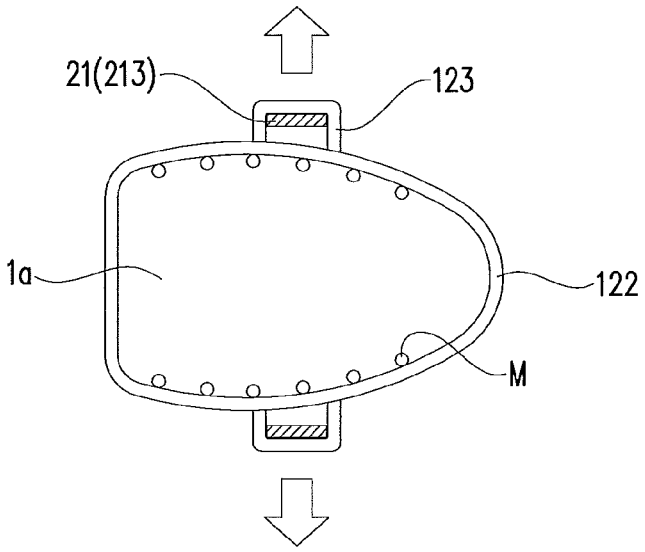
FIG. 5A is a schematic cross sectional view taken along the pressing portions, the view illustrating a further opened state from a neutral state, of the opened/closed state of the deformable portion by means of the opening and closing portion according to the embodiment of the present invention.
Figure 5B:
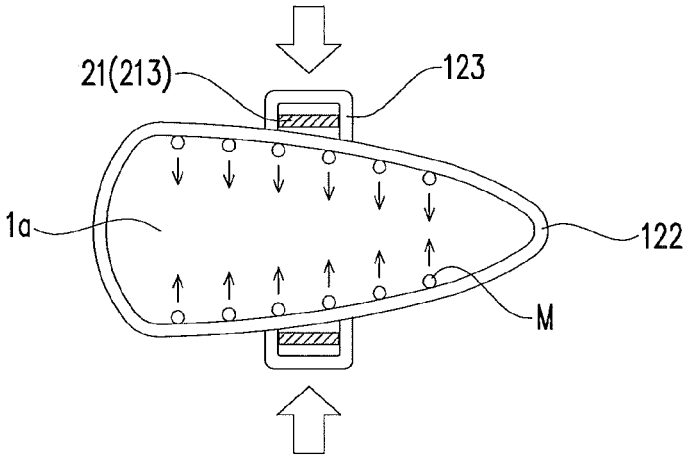
FIG. 5B is a schematic cross sectional view taken along the pressing portions, the view illustrating a slightly closed state from the neutral state, of the opened/closed state of the deformable portion by means of the opening and closing portion according to the embodiment of the present invention.

As illustrated in FIG. 5A, the movement in the separating direction is made such that the passage 1*a* is widened by pushing when the hooking portions 213 of the operation pieces 21 respectively abut against the inner surfaces of the hopper's lock portions 123 of the nozzle 12. Then, for example, as illustrated in FIG. 4A, the movement in the approaching direction is made such that the passage 1*a* is collapsed by pushing when the center-side cushioning portions 212*a* of the operation pieces 21 press the outer surface of the nozzle 12. Note that, in FIG. 5A and FIG. 5B, a change in shape of the deformable portion 122 is expressed more exaggeratingly than in reality.

The operation pieces 21 reciprocate as described above, whereby the deformable portion 122 of the hopper 1 can be bent. Then, this reciprocation is repeated, whereby the deformable portion 122 can be vibrated. The vibrations apply a force in the direction in which the medicine M moves toward the inside of the passage 1*a* as indicated by arrows in FIG. 5B, to the medicine M adhering to the inner surface of the deformable portion 122 as illustrated in FIG. 5A. As a result, the medicine M separates from the inner surface of the deformable portion 122. Accordingly, the medicine M is forced to drop from the deformable portion 122. Here, in the nozzle 12 corresponding to the lower portion of the hopper 1, when the passage 1*a* is closed, the medicine M is stored on the inner surface above the portion in which the deforming operation portion 2 is provided, and hence the medicine M is likely to remain on the inner surface so as to stick thereto. If the deformable portion 122 is vibrated, the medicine M can be intensively and effectively forced to drop from even the inner surface of the nozzle 12 on which the medicine M is likely to remain as described above. Note that, in addition to the above-mentioned case where the medicine M separates from the inner surface of the deformable portion 122, the medicine M may adhere to the inner surface of the deformable portion 122 in the state where close contact thereof with the inner surface of the deformable portion 122 is weakened by the vibrations of the deformable portion 122. In this case, the medicine M adhering to the inner surface of the deformable portion 122 can be removed from the deformable portion 122 through suction by the suction portion 5 to be described later.

In the present embodiment, the vibrations that are generated in the deformable portion 122 when the operation pieces 21 reciprocate as described above have a constant amplitude and a constant frequency. Alternatively, the vibrations may be vibrations having a changing amplitude and a changing frequency, and may be impact-like vibrations (that is, intermittent vibrations having a changing amplitude and a changing frequency).

The reciprocation of the operation pieces 21 for the remaining medicine process of the hopper 1 is performed after the end of a dispensing and packing operation of the medicine dispensing and packing apparatus. During the dispensing and packing operation of the medicine dispensing and packing apparatus, the operation pieces 21 operate only to open and close the passage 1*a* in the deformable portion 122 for the purpose of medicine take-out from the hopper 1 and medicine storage in the hopper 1. The present invention is not limited thereto, and the reciprocation of the operation pieces 21 for the remaining medicine process of the hopper 1 may be performed for each opening and closing operation of the operation pieces 21 for the purpose of controlling medicine take-out from the hopper 1.

—Opening and Closing Shutter and Suction Portion—

In the present embodiment, as illustrated in FIG. 6, an opening and closing shutter 4 is located above the hopper 1. The opening and closing shutter 4 can move parallel to the upper end edge 114 of the hopper 1. Then, as indicated by a broken line in FIG. 6, the opening and closing shutter 4 can be moved to immediately above the hopper 1 to cover the upper-end opening of the hopper 1.

The suction portion 5 is located in the cut-out portion 115 provided to the hopper body 11. The suction portion 5 is provided to suction the remaining medicine in the hopper 1. As illustrated in FIG. 6, the suction portion 5 includes an upper-stage suction port 51 and a lower-stage suction port 52 that are arranged in two stages and are opened toward the inside of the hopper 11. In the present embodiment, suction is always performed from the upper-stage suction port 51 during the dispensing and packing operation of the medicine dispensing and packing apparatus. Meanwhile, suction is performed from the lower-stage suction port 52 after the end of the dispensing and packing operation of the medicine dispensing and packing apparatus. Then, with regard to the suctioning force, the suctioning force from the lower-stage suction port 52 is stronger than the suctioning force from the upper-stage suction port 51.

The medicine (remaining medicine) M is forced to drop the inner surface of the deformable portion 122 by vibrations applied by the deforming operation portion 2. A part of the medicine (remaining medicine) M drops downward from the medicine output port 121, and is received by a portion ("empty package") with which the medicine M is not packed, of the packing paper P. Then, another part of the medicine (remaining medicine) M is suctioned from the lower-stage suction port 52. Note that the opening and closing shutter 4 covers the upper-end opening of the hopper 1, at the time of the remaining medicine process of the hopper 1 by the operation pieces 21 after the end of the packing operation of the medicine packing apparatus. As a result, air is restricted from flowing in from above the hopper 1, and hence suction from the suction portion 5 (particularly, the lower-stage suction port 52) can be efficiently performed.

Note that, in the present embodiment, the deforming operation portion 2 is used as the opening and closing portion to deform the deformable portion 122 and open and close the passage 1*a*, and is also used as the deformable portion vibrator to apply vibrations to the deformable portion 122, but the present invention is not limited to such a configuration in which the deforming operation portion 2 doubles as the opening and closing portion and the deformable portion vibrator. Accordingly, for example, the deforming operation portion 2 may be used as only the opening and closing portion, and the vibrator 32 to be described later for vibrating the entire hopper 1 may be used as the deformable portion vibrator. In other words, the opening and closing portion and the deformable portion vibrator may be provided independently of each other. Note that it is more preferable that the opening and closing portion double as the deformable portion vibrator as in the present embodiment, because the medicine M can be suppressed from remaining in the hopper 1 without an increase in manufacturing cost of the medicine supply apparatus A.

—Hopper Holder and Other Members—

In the present embodiment, as illustrated in FIG. 2, the hopper 1 is held by a frame-like hopper holder 31. The hopper holder 31 is located at a position between the upper end and the lower end of the hopper 1. The hopper holder 31 includes a securing clip 311. The holder mounting portion 113 of the hopper 1 is sandwiched by the securing clip 311, whereby the hopper 1 can be held by the hopper holder 31. Moreover, the hopper holder 31 is supported by springs 33. In the present embodiment, coil springs are used for the springs 33, but the present invention is not limited thereto, and various springs such as plate springs can be used therefor.

—Vibrator—

The hopper holder 31 of the present embodiment includes the vibrator 32 for vibrating the entire hopper 1. As illustrated in FIG. 2, the vibrator 32 is fixed to the hopper holder 31 using a mounting portion 32*a* made of a metal plate. A vibrating motor having a rotating shaft to which an eccentric weight is attached is used for the vibrator 32 of the present embodiment, and the vibrator 32 generates vibrations having a constant amplitude and a constant frequency. Alternatively, a conventionally existing mechanism that generates impacts (intermittent vibrations having a changing amplitude and a changing frequency) using a solenoid or the like may be used therefor. Moreover, a mechanism that generates vibrations using an electromagnet or the like may be used therefor.

Because the hopper holder 31 is supported by the springs 33 as described above, the hopper holder 31 is swung by vibrations generated by the vibrator 32, and the hopper 1 is also swung along therewith. As described above, the hopper 1 is made of rubber, and the stiffness of the flat plate portion 112 is lower than the stiffness of the frame body 111. Hence, the inner surface of the flat plate portion 112 can be undulated by the above-mentioned swings in the entire hopper 1, and the remaining medicine M can be effectively forced to drop. Note that, in addition to the vibrator 32, the deformable portion 122 is vibrated by the deforming operation portion 2, whereby the medicine M remaining in the hopper 1 can be more effectively forced to drop. In this way, the vibrator 32 and the deforming operation portion 2 are used in combination to remove the medicine M or force the medicine M to drop, whereby the hopper 1 can be effectively cleaned.

The above description is summarized below. The medicine supply apparatus A according to one embodiment includes: the hopper 1 including the passage 1*a* that allows the medicine M to pass downward therethrough; and the deforming operation portion 2. A part of the lower portion of the hopper 1 is configured as the deformable portion 122 having flexibility. The deformable portion 122 is deformable so as to open and close the passage 1*a*. The deforming operation portion 2 deforms the deformable portion 122 to thereby open and close the passage 1*a*, and applies vibrations to the deformable portion 122. The medicine M adhering to the inner surface of the deformable portion 122 is processed by the applied vibrations.

In this configuration, the deformable portion 122 is deformed by the vibrations applied by the deforming operation portion 2. The medicine M adhering to the inner surface of the deformable portion 122 is forced to drop therefrom by this deformation. Hence, the process of removing the medicine M from the deformable portion 122 can be performed by applying the vibrations to the lower portion of the hopper 1.

In the present embodiment, the deformable portion 122 may include the hopper's lock portions 123 to be engaged with the deforming operation portion 2, on one side and another side with the passage 1*a* therebetween, the deforming operation portion 2 may include the pair of operation pieces 21, 21 that are located so as to sandwich the deformable portion 122 from the one side and the other side, and each of the operation pieces 21 may include the deforming operation portion's lock portion (hooking portion) 213 to be engaged with the hopper's lock portion 123.

Moreover, the deforming operation portion 2 may include the pair of operation pieces 21, 21 that are located so as to sandwich the deformable portion 122 from the one side and the other side with the passage 1*a* therebetween, and each of the operation pieces 21 may generate the vibrations by repeating: the movement in the direction in which the passage 1*a* in the deformable portion 122 is widened; and the movement in the direction in which the passage 1*a* in the deformable portion 122 is narrowed.

In these configurations, the pair of operation pieces 21, 21 deform the deformable portion 122 to thereby generate the vibrations. Hence, the deformable portion 122 can be vibrated with a simple configuration.

Moreover, the medicine supply apparatus A according to another embodiment includes: the hopper 1 including the passage 1*a* that allows the medicine M to pass downward therethrough; the opening and closing portion (deforming operation portion) 2; and the deformable portion vibrator (the deforming operation portion, the vibrator) 2, 32. A part of the lower portion of the hopper 1 is configured as the deformable portion 122 having flexibility. The deformable portion 122 is deformable so as to open and close the passage 1*a*. The opening and closing portion (deforming operation portion) 2 deforms the deformable portion 122 to thereby open and close the passage 1*a*. The deformable portion vibrator (the deforming operation portion and the vibrator) 2 and 32 applies vibrations to the deformable portion 122. The medicine M adhering to the inner surface of the deformable portion 122 is processed by the applied vibrations.

In this configuration, the deformable portion 122 is deformed by the vibrations applied by the deformable portion vibrator (the deforming operation portion and the vibrator) 2 and 32. The medicine M adhering to the inner surface of the deformable portion 122 is forced to drop therefrom by this deformation. Hence, the process of removing the medicine M from the deformable portion 122 can be performed by applying the vibrations to the lower portion of the hopper 1.

Moreover, the process for the medicine M may include vibrating the deformable portion 122 to thereby separate the medicine M adhering to the inner surface of the deformable portion 122 from the inner surface 122.

According to the above-mentioned embodiments, in the lower portion of the hopper 1, which is a portion of the hopper 1 in which the medicine M is likely to remain, the medicine M can be forced to drop by the applied vibrations. Hence, it is possible to provide the medicine supply apparatus A including the hopper 1 in which the medicine M is less likely to remain. Then, it is possible to provide the medicine supply apparatus A that can process even the medicine M that remains in the lower portion of the hopper 1.

Hereinabove, the embodiments of the present invention have been described, but the present invention is not limited to the above-mentioned embodiments, and can be variously changed within a range not departing from the gist of the present invention.

REFERENCE SIGNS LIST

1 hopper
1*a* passage
122 deformable portion
123 hopper's lock portion
2 deforming operation portion, opening and closing portion, deformable portion vibrator
21 operation piece
211 pressing portion
213 deforming operation portion's lock portion, hooking portion
31 hopper holder
32 deformable portion vibrator, vibrator
A medicine supply apparatus
B dispensing and packing apparatus
P packing paper
M medicine

The invention claimed is:

1. A medicine supply apparatus comprising:
a hopper including a passage that allows medicine to pass downward therethrough; and
a deforming operation portion, wherein
a part of a lower portion of the hopper is configured as a deformable portion having flexibility,
the deformable portion is deformable so as to open and close the passage,
the deforming operation portion deforms the deformable portion to thereby open and close the passage, and applies vibrations to the deformable portion, and
the medicine adhering to an inner surface of the deformable portion is processed by the applied vibrations, wherein
the deformable portion includes hopper's lock portions located on one side and another side with the passage there between to be engaged with the deforming operation portion,
the deforming operation portion includes a pair of operation pieces that are located so as to sandwich the deformable portion from the one side and the other side, and
each of the operation pieces includes a deforming operation portion's lock portion to be engaged with the hopper's lock portion.

2. The medicine supply apparatus according to claim 1, wherein
the deforming operation portion includes the pair of operation pieces that are located so as to sandwich the deformable portion from the one side and the other side with the passage therebetween, and
each of the operation pieces generates the vibrations by repeating: a movement in a direction in which the passage in the deformable portion is widened; and a movement in a direction in which the passage in the deformable portion is narrowed.

3. The medicine supply apparatus according to claim 1, wherein the process for the medicine includes vibrating the deformable portion to thereby separate the medicine adhering to the inner surface of the deformable portion from the inner surface.

4. A medicine supply apparatus comprising:
a hopper including a passage that allows medicine to pass downward therethrough; and
a deforming operation portion, wherein
a part of a lower portion of the hopper is configured as a deformable portion having flexibility,
the deformable portion is deformable so as to open and close the passage, the deforming operation portion deforms the deformable portion to thereby open and close the passage, and applies vibrations to the deformable portion, and the medicine adhering to an inner surface of the deformable portion is processed by the applied vibrations, wherein the deforming operation portion includes the pair of operation pieces that are located so as to sandwich the deformable portion from the one side and the other side with the passage therebetween, and each of the operation pieces generates the vibrations by repeating: a movement in a direction in which the passage in the deformable portion is widened; and a movement in a direction in which the passage in the deformable portion is narrowed.

5. The medicine supply apparatus according to claim 4, wherein the process for the medicine includes vibrating the deformable portion to thereby separate the medicine adhering to the inner surface of the deformable portion from the inner surface.

* * * * *